US012520913B2

(12) United States Patent
Suzuki

(10) Patent No.: US 12,520,913 B2
(45) Date of Patent: Jan. 13, 2026

(54) CLASP AND BAND

(71) Applicant: Casio Computer Co., Ltd., Tokyo (JP)

(72) Inventor: Junichiro Suzuki, Tokyo (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 147 days.

(21) Appl. No.: 18/596,333

(22) Filed: Mar. 5, 2024

(65) Prior Publication Data

US 2024/0298759 A1 Sep. 12, 2024

(30) Foreign Application Priority Data

Mar. 8, 2023 (JP) ..... 2023-035172

(51) Int. Cl.
*A44C 5/24* (2006.01)
*A44C 5/02* (2006.01)
*A44C 5/20* (2006.01)

(52) U.S. Cl.
CPC ..... *A44C 5/2028* (2013.01); *A44C 5/025* (2013.01); *A44C 5/2066* (2013.01)

(58) Field of Classification Search
CPC ..... A44C 5/2028; A44C 5/025; A44C 5/2066; A44C 5/24; A44C 5/243; A44C 5/246; A44C 5/16; A44C 5/145; A44B 11/2515; A44B 11/266; A44B 11/2519; Y10T 24/4782; G04B 37/18
USPC ..... 368/282
See application file for complete search history.

(56) References Cited

U.S. PATENT DOCUMENTS 2,997,761 A * 8/1961 Davis ..... A44B 11/28 24/68 E
5,771,543 A * 6/1998 Froidevaux ..... A44C 5/246 24/69 J
6,308,382 B1 * 10/2001 Takahashi ..... A44C 5/24 24/71 J
6,401,307 B1 * 6/2002 Wild ..... A44C 5/246 24/71 J
6,694,578 B1 * 2/2004 Nicoll ..... A44B 11/2519 24/642

(Continued)

FOREIGN PATENT DOCUMENTS

JP H10192014 A * 7/1998
JP 2001104022 A * 4/2001

(Continued)

OTHER PUBLICATIONS

Office Action, dated Jan. 28, 2025, for Japanese Patent Application No. 2023-035172. (6 pages) (with English Translation).

*Primary Examiner* — Jack W Lavinder
(74) *Attorney, Agent, or Firm* — Seed Intellectual Property Law Group LLP

(57) ABSTRACT

A clasp including: a first extension link that is formed in a U-shape and in which a closed end side is rotatably supported at one end of a clasp cover of a band; and a second extension link connected to an open end side of the first extension link via a connecting member, wherein, the second extension link is fixed to the first extension link at a position different from a connected position in the connecting member, and the first extension link is fixed to the clasp cover at a position different from the one end of the clasp cover where the first extension link is rotatably supported.

19 Claims, 4 Drawing Sheets

(56) References Cited

U.S. PATENT DOCUMENTS 6,944,916 B2 * 9/2005 Kawagoe ..... A44C 5/246 24/70 J
7,571,519 B2 * 8/2009 Sierro ..... A44C 5/185 24/71 J
7,861,383 B2 * 1/2011 Yamamoto ..... A44C 5/246 368/282
8,196,267 B2 * 6/2012 Nalley ..... A44C 5/24 24/71 J
8,739,369 B2 * 6/2014 Kaltenrieder ..... A44C 5/24 63/3.1
8,789,246 B2 * 7/2014 Yliluoma ..... A44C 5/246 24/71 J
10,278,460 B2 * 5/2019 Catanese ..... A44C 5/246
10,588,384 B2 * 3/2020 Dos Santos Pedrosa ..... A44C 5/246
11,000,101 B2 * 5/2021 Webb ..... A44C 5/0007
11,089,849 B2 * 8/2021 Granito ..... A44C 5/246
11,284,684 B2 * 3/2022 Schaller ..... A44C 5/02
2004/0083581 A1 * 5/2004 Kawagoe ..... A44C 5/185 24/265 WS
2007/0125123 A1 * 6/2007 Sierro ..... A44C 5/246 63/3.2
2009/0049667 A1 * 2/2009 Takahashi ..... A44C 5/246 24/71 J
2011/0107566 A1 * 5/2011 Nalley ..... A44C 5/24 24/490
2012/0312052 A1 * 12/2012 Yliluoma ..... A44C 5/246 24/265 EC
2013/0145795 A1 * 6/2013 Asami ..... A44C 5/02 403/119
2014/0352119 A1 * 12/2014 Kaltenrieder ..... A44C 5/246 24/71 J
2018/0027929 A1 * 2/2018 Renforth ..... A01K 27/001
2020/0405018 A1 * 12/2020 Granito ..... A44C 5/246
2021/0274893 A1 * 9/2021 Nakatsuka ..... A44C 5/107
2022/0061474 A1 * 3/2022 Nakatsuka ..... A44C 5/0061
2023/0000219 A1 * 1/2023 Yamashita ..... A44C 5/24
2023/0000220 A1 * 1/2023 Yamashita ..... A44C 5/24
2023/0176528 A1 * 6/2023 Maruyama ..... A44C 5/107 368/282
2023/0413958 A1 * 12/2023 Amano ..... B33Y 80/00
2024/0298759 A1 * 9/2024 Suzuki ..... A44C 5/2028

FOREIGN PATENT DOCUMENTS

JP 2003199605 A * 7/2003
JP 3144221 U * 8/2008
JP 2013121508 A * 6/2013 ..... A44B 11/12
JP 2022118342 A * 8/2022 ..... A44C 11/12
JP 2022145621 A * 10/2022 ..... A44C 5/246

* cited by examiner

CLASP AND BAND

REFERENCE TO RELATED APPLICATIONS

This application is based upon and claims the benefit of priority from the prior Japanese Patent Application No. 2023-035172, filed on Mar. 8, 2023, the entire contents of which are incorporated herein by reference.

BACKGROUND OF THE INVENTION

Field of the Invention

The present invention relates to a clasp and a band.

Description of the Related Art

Conventionally, a band connected by a clasp is known as a band that is attached to a device case such as a wristwatch and worn on the arm or the like.

Depending on the device, such as a watch, to which the band is attached, it is assumed that the band will be worn over the sleeve of clothes, etc., in addition to normal use. For example, a so-called diver's watch worn while diving is assumed to be worn over a wetsuit made of thick fabric. In the band attached to such device, it is preferable that the length of the band can be easily adjusted between the normal usage state in which the band is worn directly on the arm and the usage state for a predetermined purpose in which the band is worn over a wetsuit or the like.

For example, Japanese Unexamined Patent Publication No. 2001-104022 describes a configuration in which a spring bar connected to a band link is slidable in a longitudinal direction of the band within a sliding window of a length adjusting plate.

According to the above, it becomes possible to perform fine adjustment of the band length within the range of the sliding window of the length adjustment plate.

SUMMARY

In order to solve the above problems, the clasp according to the present invention includes: a first extension link that is formed in a U-shape and in which a closed end side is rotatably supported at one end of a clasp cover of a band; and a second extension link connected to an open end side of the first extension link via a connecting member, wherein, the second extension link is fixed to the first extension link at a position different from a connected position in the connecting member, and the first extension link is fixed to the clasp cover at a position different from the one end of the clasp cover where the first extension link is rotatably supported.

DETAILED DESCRIPTION OF THE PREFERRED EMBODIMENTS

Hereinafter, an embodiment of a structure of the present invention will be described with reference to the drawings.

A band according to this embodiment is assumed to be used in a normal usage state in which it is worn directly on an arm, etc., and in a usage state in which a band length is longer than usual and the band is worn over clothes, etc. Accordingly, the band length can be easily adjusted at a clasp portion depending on the usage state. An assumed example of the usage state in which the band is worn over the clothes may be, for example, when the band with a clasp is a watch band that is attached to a device case of a watch (for example, a so-called diver's watch), and the band is worn over a wetsuit while diving, etc.

Various limitations that are technically preferable to implement the present disclosure are added to the embodiments described below. However, the scope of the present disclosure is not limited to the embodiments and the illustrated examples described below.

[Configuration]

An embodiment of the clasp according to the present embodiment and a band having the clasp will be described with reference to FIGS. 1 to 9.

Figure 1:
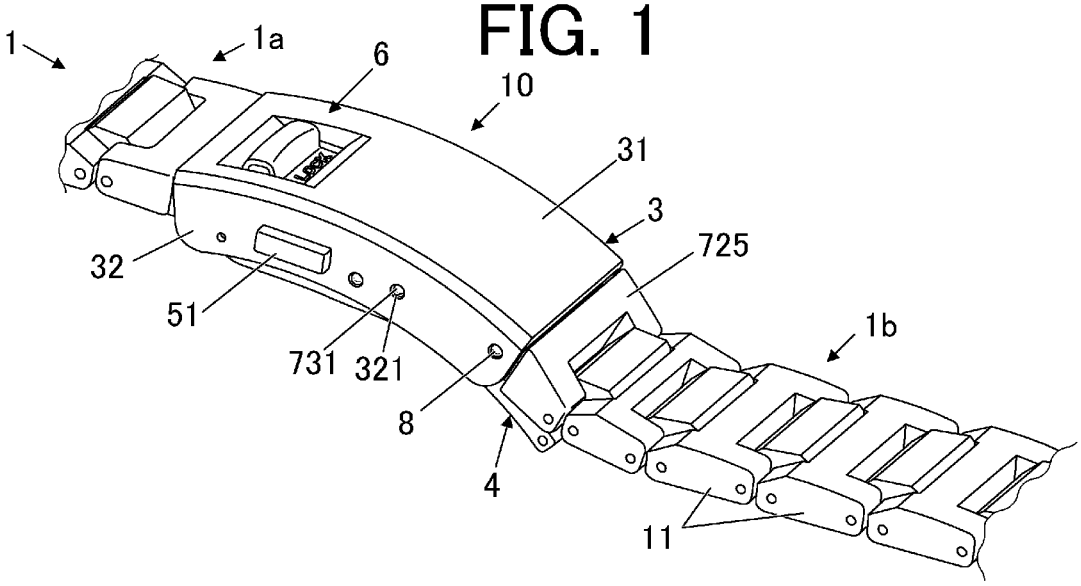
FIG. 1 is a perspective view of a clasp in which an extension link is in a stored state in which the extension link is stored inside a clasp cover and a band including the clasp.
Figure 2:
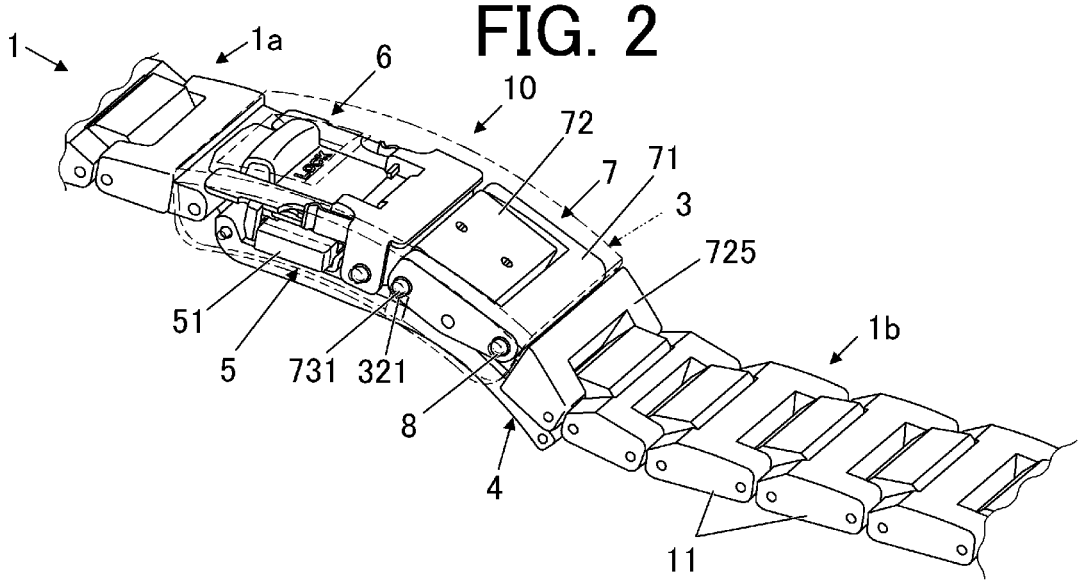
FIG. 2 is a perspective view of the clasp and the band including the clasp shown in FIG. 1 with the clasp cover shown in a transparent state.
Figure 3:
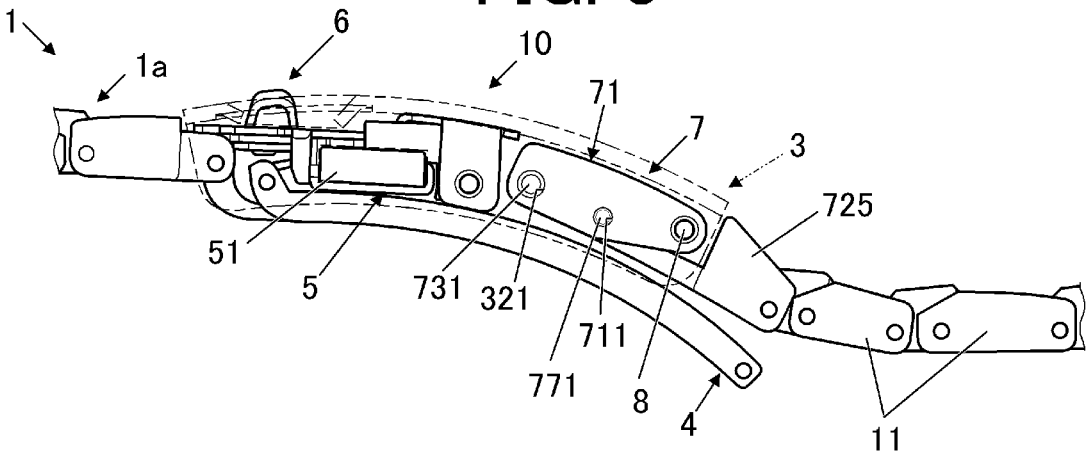
FIG. 3 is a side view of the clasp and the band including the clasp shown in FIG. 2.
Figure 4:
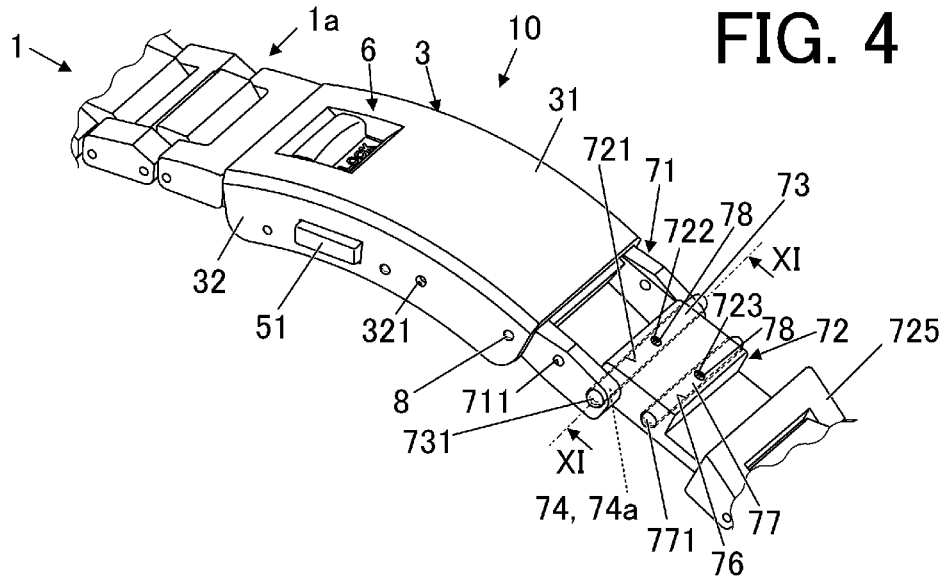
FIG. 4 is a perspective view of the clasp in which the extension link is in a band extended state in which the extension link is pulled out from inside the clasp cover and the band including the clasp.
Figure 5:
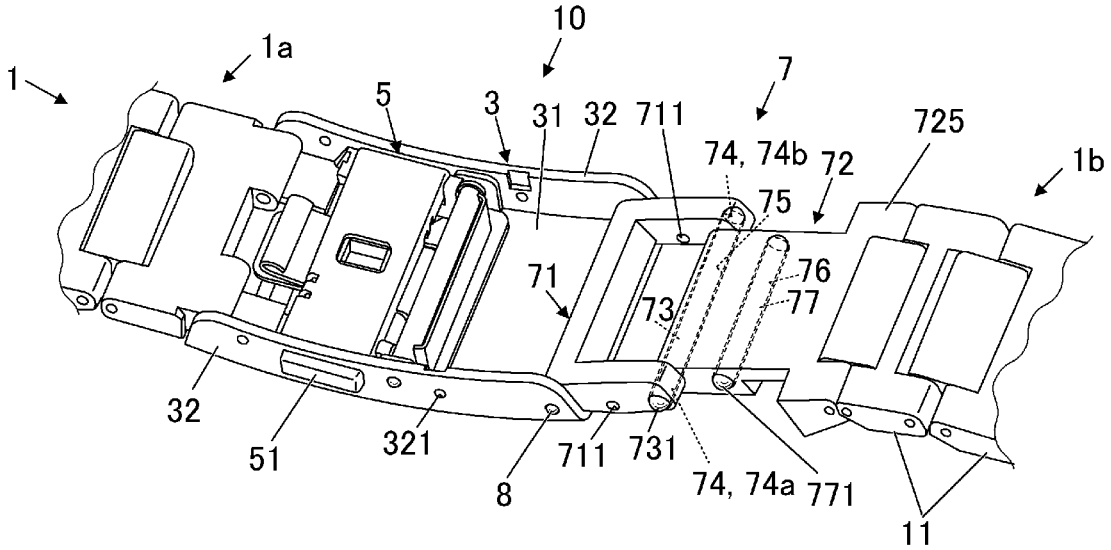
FIG. 5 is a perspective view of the clasp and the band including the clasp shown in FIG. 4 viewed from a non-visible side of the band.

FIG. 1 is a perspective view of the clasp in which an extension link is in a stored state in which the extension link is stored inside a clasp cover and a band including the clasp. FIG. 2 is a perspective view showing a configuration inside the clasp with the clasp cover of the clasp shown in FIG. 1 in a transparent state. FIG. 3 is a side view of the clasp and the band including the clasp shown in FIG. 2. FIG. 4 is a perspective view of the clasp in which the extension link is in a band extended state in which the extension link is pulled out from inside the clasp cover and the band. FIG. 5 is a perspective view of the clasp and the band shown in FIG. 4 viewed from a non-visible side of the band.

The band 1 includes a first band 1*a* attached to one end side (for example, the 6 o'clock side of an analog type watch) of a device case (not shown), and a second band 1*b* attached to the other end side (for example, the 12 o'clock side of an analog type watch). The first band 1*a* and the second band 1*b* are connected by a clasp 10.

The band 1 (first band 1*a* and second band 1*b*) is configured by connecting a plurality of links 11, as shown in FIG. 1, for example.

The link 11 included in the band 1 is formed of a metal material such as, for example, titanium, stainless steel (SUS), or aluminum. Note that the material for forming the link 11 is not limited to those exemplified herein.

The clasp 10 includes a clasp cover 3 and a component that overlaps the inside (non-visible side) of the clasp cover 3.

The clasp cover 3 is a metal component formed of a metal material such as, for example, titanium, stainless steel (SUS), or aluminum.

As shown in FIGS. 1 to 5, etc., the clasp cover 3 is formed to be elongated along a length direction of the band 1, and constitutes an outer appearance of the clasp 10.

Specifically, the clasp cover 3 includes a front plate 31 that is a long flat plate that constitutes the outer surface of the clasp cover 3, and a pair of side walls 32 that are vertically disposed on both sides of the front plate 31. A space surrounded by the front plate 31 and the pair of side walls 32 serves as a storage region in which various components constituting the clasp 10 are stored.

One end of the clasp cover 3 (left side in FIGS. 1 to 5) is latched with one end of a fold over member 4 (see FIG. 3, etc.). When the first band 1*a* and the second band 1*b* are connected by the clasp 10, the fold over member 4 is arranged on the non-visible side of the clasp cover 3 (storage region of the clasp cover 3) substantially along the clasp cover 3 in a folded state in which the two plate members are folded over each other.

Further, as shown in FIGS. 2 and 3, the clasp 10 of this embodiment includes, as a component, a latching unit 5 that maintains the folded state of the fold over member 4 arranged in the folded state.

The clasp 10 according to the present embodiment is a clasp of a three-fold type band in which the fold over member 4 in the folded state is arranged on the non-visible side of the clasp cover 3 together with the latching unit 5.

The latching unit 5 includes push buttons 51 that respectively protrude from each of the pair of side walls 32 of the clasp cover 3, and when the push buttons 51 are pushed in from both sides of the clasp cover 3, the folded state of the fold over member 4 is released.

When the folded state of the fold over member 4 is released, the connected state in which the first band 1*a* and the second band 1*b* are connected becomes a connection released state in which the connected state is released, and the band 1 can be removed from the target where the band 1 is worn such as the user's arm or the like.

Further, as shown in FIG. 1 and the like, the clasp 10 of this embodiment includes a locking mechanism 6 that locks (restricts) the movement of the push button 51 of the latching unit 5 from being pushed inward. This prevents the band 1 from being a connection released state due to the push button 51 being pushed in unintentionally.

As shown in FIGS. 2, 3, and 5, in this embodiment, the latching unit 5 and the locking mechanism 6 are configured to be stored in a latched end side of the fold over member 4 (left side in FIGS. 1 to 5) in the storage region inside the clasp cover 3 (on the non-visible side).

As shown in FIGS. 2 and 3, the storage region on the other end side of the clasp cover 3 (the opposite side from the side where the fold over member 4 is latched, the right side in FIGS. 1 to 5) stores an extension link 7.

The extension link 7 includes a component that can easily extend a length of the band 1 even when the first band 1*a* and the second band 1*b* are in a connected state connected by the clasp 10.

The extension link 7 includes a first extension link 71 and a second extension link 72, and the first extension link 71 and the second extension link 72 can be stored inside the clasp cover 3 (non-visible side) in the folded state.

Specifically, as shown in FIG. 5, the first extension link 71 is formed into a substantial U-shape, and the closed end side (closed side of the U-shape) is rotatably supported by a support shaft 8 on the inner side at the end of the clasp cover 3 of the band 1 (right end in FIGS. 1 to 5).

According to the present embodiment, when the first extension link 71 and the second extension link 72 are stored inside the clasp cover 3 in the folded state, as shown in FIGS. 2 and 3, when the fold over member 4 in the folded state is positioned on the non-visible side of the clasp cover 3 together with the latching unit 5, the extension link 7 is stored on the non-visible side (inside) of the clasp cover 3 sandwiched between the fold over member 4 and the clasp cover 3.

The second extension link 72 is connected to the open end side (the open side of the U-shape) of the first extension link 71 via a first spring bar 73 (connection member) The second extension link is configured to be able to be a folded state in which it is arranged to overlap with the first extension link 71 and an extended state in which it is pulled out in the length direction of the band 1. That is, the second extension link 72 is formed to fit inside the first extension link 71 which is formed in a substantial U-shape.

Therefore, in the folded state, the first extension link 71 and the second extension link 72 are arranged compactly in a space equal to the length of the first extension link 71 (the length in the length direction of the band 1) (See FIGS. 2 and 3). Further, when in the extended state, the length of the extension link 7 becomes longer than the first extension link 71 by the amount by which the second extension link 72 is pulled out (see FIGS. 4 and 5).

The second extension link 72 may have a width that fits inside the first extension link 71 formed in a substantial U-shape, and may be smaller than the space width inside the first extension link 71. However, from the viewpoint of strength when it is pulled out from the inside of the first extension link 71 and in the extended state, it is preferable to have a width that allows it to fit inside the first extension link 71 with almost no gaps.

In addition, a connecting part 725 that is connected to the links 11 constituting the band 1 (second band 1*b*) is continuously provided on the opposite side of the second extension link 72 from the side where the second extension link 72 is connected to the first extension link 71.

The first spring bar 73 extends through the first extension link 71 and the second extension link 72 in a penetrating state penetrating in the width direction of the band 1.

Figure 6:
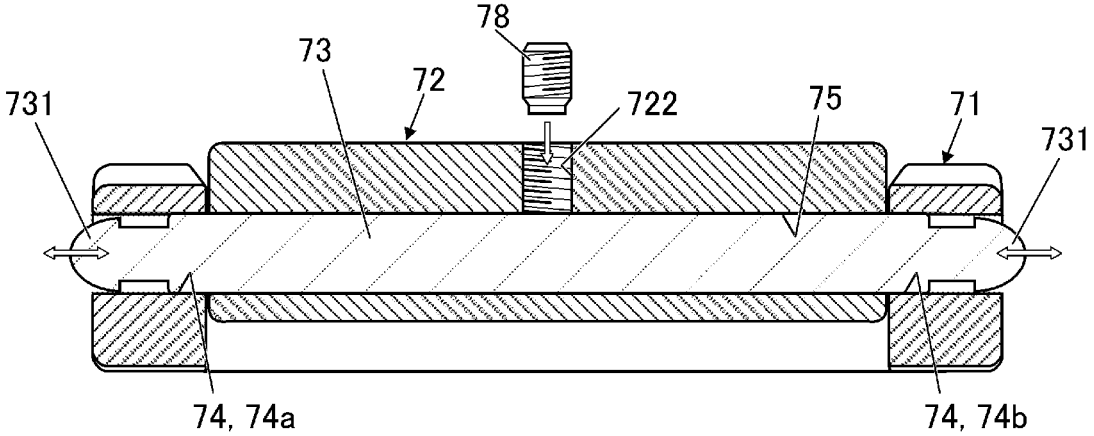
FIG. 6 is a cross-sectional view of the extension link taken along a line XI-XI shown in FIG. 4.

FIG. 6 is a schematic cross-sectional view taken along the line XI-XI in FIG. 4. FIG. 6 shows a state in which the first spring bar 73 penetrates the first extension link 71 and the second extension link 72.

As shown in FIG. 6, first through holes 74 (indicated as first through holes 74*a* and 74*b* in FIG. 6) that penetrate in the width direction of the band 1 are formed on the open end side of the first extension link 71.

Further, a second through hole 75 that communicates with the first through hole 74 (first through holes 74*a*, 74*b*) of the first extension link 71 and that penetrates through the band 1 in the width direction of the band 1 is formed in the second extension link 72 on the side attached to the first extension link 71.

The first spring bar 73 is inserted into the first through hole 74 (first through holes 74*a*, 74*b*) and the second through hole 75, and penetrates the first extension link 71 and the second extension link 72. Further, the tip portions 731 on both sides of the first spring bar 73 protrude outward beyond the first through hole 74 (first through holes 74*a*, 74*b*) of the first extension link 71 disposed on the outside.

In the stored state in which the first extension link 71 and the second extension link 72 are stored inside the clasp cover 3, the tip portions 731 on both sides of the protruding first spring bar 73 are latched to the clasp cover 3.

That is, the pair of side walls 32 that are the side surfaces of the clasp cover 3 are portions in which the first extension link 71 and the second extension link 72 are stored, and holes 321 are formed corresponding to the positions of the tip portions 731 of the first spring bar 73.

When the first extension link 71 and the second extension link 72 are stored inside the clasp cover 3, the tip portions 731 on both sides of the first spring bar 73 are fitted in these holes 321.

As described above, the clasp 10 has the first extension link 71 formed in a U-shape and whose closed end side is rotatably supported at one end of the clasp cover 3 of the band 1, and the second extension link 72 connected to the open end side of the first extension link 71 via the connecting member (first spring bar 73). The second extension link 72 is fixed to the first extension link 71 at a position different from the connecting position in the connecting member (first spring bar 73). The first extension link 71 is fixed to the clasp cover 3 at a position different from the position where it is rotatably supported at one end of the clasp cover 3.

Note that the tip portions 731 of the first spring bar 73 preferably have a rounded shape. Since the tip portions 731 are rounded, when the extension link 7 with the first spring bar 73 inserted therein is stored inside the clasp cover 3, it is difficult for the first spring bar 73 to get caught on the side wall 32, etc. of the clasp cover 3. Therefore, the first spring bar 73 can be fitted with little resistance.

The first spring bar 73 which has been compressed to the extent that it does not get caught on the clasp cover 3 returns to its original length due to the reaction force of the spring when it fits into the hole 321, and is firmly latched in the hole 321.

Further, a screw hole 722 is formed in the second extension link 72 so as to be perpendicular to the second through hole 75 from either surface. In this embodiment, as shown in FIG. 2 etc., on the surface of the second extension link 72, the screw hole 722 is formed from the surface facing the inner surface of the front plate 31 of the clasp cover 3 toward the second through hole 75 in a state where the extension link 7 is stored inside the clasp cover 3 (see FIGS. 4 and 6).

As shown in FIG. 6, a set screw 78 is provided in the screw hole 722 in a state in which the first spring bar 73 is inserted into the second through hole 75. The set screw 78 is screwed in until its tip strikes the first spring bar 73. With this, the position of the first spring bar 73 in the second through hole 75 is fixed by the set screw 78 inserted into the second extension link 72 from a direction perpendicular to the extending direction of the first spring bar 73. The set screw 78 should not protrude from the screw hole 722 to the outside of the second extension link 72 and the specific shape of the set screw 78 is not limited.

Further, as shown in FIGS. 4 and 5, inside the second extension link 72, a third through hole 76 is formed so as to be substantially parallel to the first through hole 74 (first through holes 74*a*, 74*b*) and the second through hole 75. A second spring bar 77 is inserted into the third through hole 76.

The second spring bar 77 is positioned substantially parallel to the first spring bar 73, and extends in a penetrating state penetrating through the second extension link 72 in the width direction of the band 1.

Similar to the tip portions 731 on both sides of the first spring bar 73, preferably, the tip portions 771 on both sides of the second spring bar 77 have a rounded shape. Since the tip portions 771 are rounded, when the second extension link 72 with the second spring bar 77 inserted therein is fitted in the space in the U-shaped space so that it overlaps with the first extension link 71, it is difficult for the second spring bar 77 to get caught by the first extension link 71 etc. Therefore, the second spring bar 77 can be fitted with little resistance.

In the folded state in which the second extension link 72 is arranged so as to overlap with the first extension link 71, a hole 711 is formed on the inside of the first extension link 71 corresponding to the tip portions 771 on both sides of the second spring bar 77.

When the second extension link 72 is fitted in the first extension link 71, the tip portions 771 on both sides of the second spring bar 77 are fitted in the holes 711.

The second spring bar 77 which has been compressed to the extent that it does not get caught in the first extension link 71, etc. returns to its original length due to the reaction force of the spring when it fits into the hole 711, and is firmly latched in the hole 711.

Further, a screw hole 723 is formed in the second extension link 72 so as to be perpendicular to the third through hole 76 from either surface. In this embodiment, similar to the above-described screw hole 722, on the surface of the second extension link 72, the screw hole 723 is formed from the surface facing the inner surface of the front plate 31 of the clasp cover 3 toward the third through hole 76 in a state where the extension link 7 is stored inside the clasp cover 3 (see FIG. 4).

As shown in FIG. 4, a set screw 78 is provided in the screw hole 723 in a state in which the second spring bar 77 is inserted into the third through hole 76. The set screw 78 is screwed in until its tip strikes the second spring bar 77. With this, the position of the second spring bar 77 in the third through hole 76 is fixed by the set screw 78 inserted into the second extension link 72 from a direction perpendicular to the extending direction of the second spring bar 77. The set screw 78 should not protrude from the screw hole 723 to the outside of the second extension link 72 and similar to the set screw 78 that fixes the first spring bar 73, the specific shape of the set screw 78 is not limited.

[Operation]

An operation of the clasp according to the present embodiment and the band having the clasp will be described with reference to the drawings.

When the first band 1*a* and the second band 1*b* are in a connected state connected by the clasp 10 and the extension link 7 is stored inside the clasp cover 3 in a folded state (state shown in FIG. 1 to FIG. 3), the above can be worn directly on the user's arm or the like. By adjusting the number of links 11 constituting the band 1 in advance, the user can adjust the band length to suit his or her arm.

When the user wears the band 1 adjusted to his/her own size over a wet suit, etc. during diving etc., the extension link 7 is pulled out from the clasp cover 3 while the clasp 10 remains in the connected state.

Figure 7:
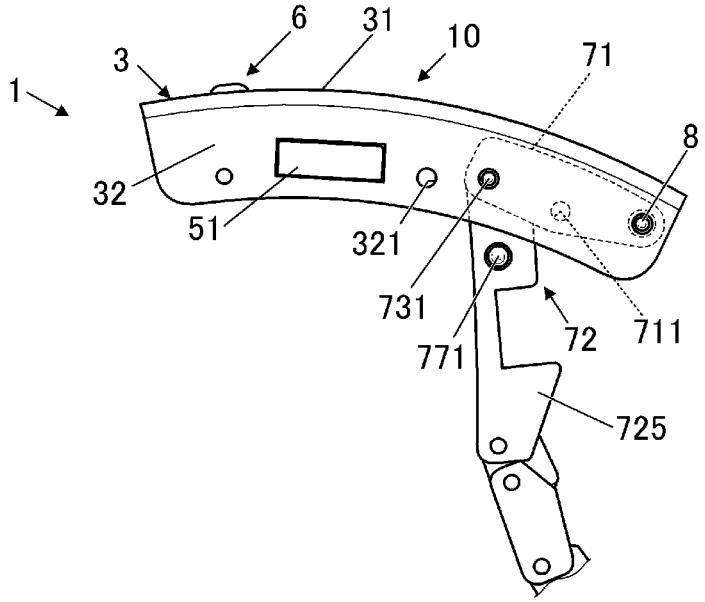
FIG. 7 is a perspective view of the clasp in which the extension link is between a stored state in which the extension link is stored inside the clasp cover and the extended state and a band including the clasp.
Figure 8:
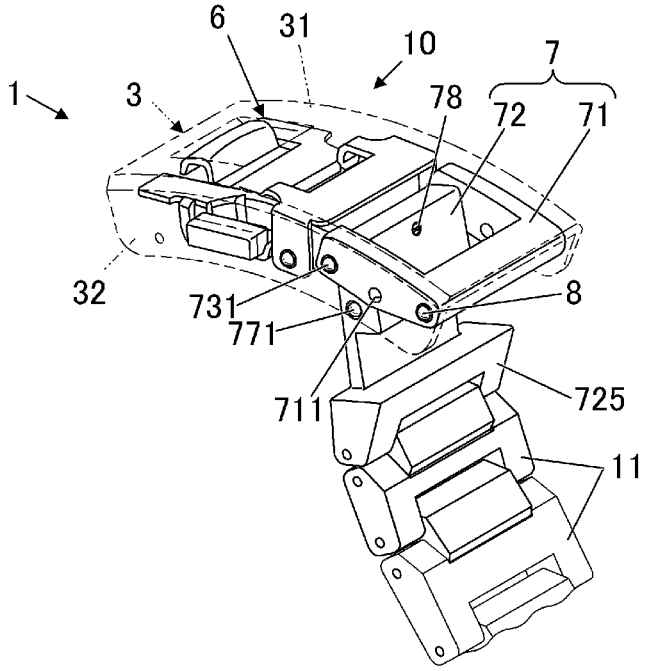
FIG. 8 is a perspective view of the clasp and the band including the clasp in the state shown in FIG. 7 with the clasp cover shown in a transparent state.

For example, in this embodiment, the tip portions 771 of the second spring bar 77 which penetrates through the second extension link 72 are latched to the holes 711 of the first extension link 71. With respect to the clasp 10, by strongly pulling the second band 1*b* provided with the extension link 7, the tip portions 771 are released from the holes 711. With this, as shown in FIGS. 7 and 8, the second extension link 72 is released from the folded state fit in the first extension link 71.

Figure 9:
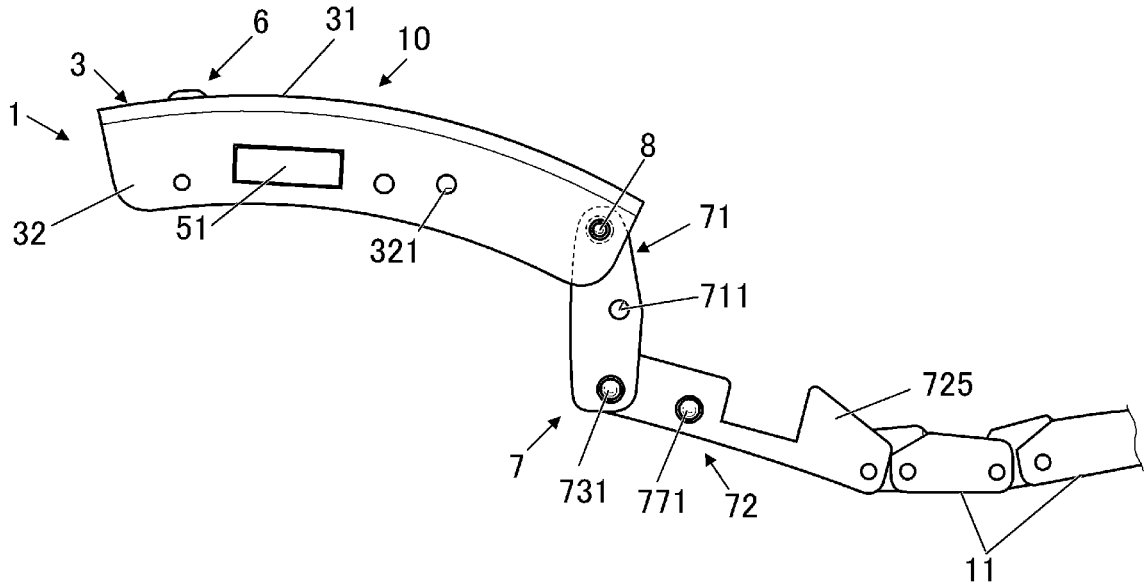
FIG. 9 is a side view of the clasp in which the extension link is between a stored state in which the extension link is stored inside the clasp cover and the extended state and a band including the clasp.

When the second band 1*b* is further pulled strongly with respect to the clasp 10, the tip portions 731 of the first spring bar 73 which penetrates the first extension link 71 and the second extension link 72 and in which the tip portions 731 are latched to the holes 321 of the clasp cover 3 are released from the holes 321, resulting in a state as shown in FIG. 9.

When the second band 1*b* is further pulled in this state to completely pull out the extension link 7 from the inside (non-visible side) of the clasp cover 3, the band is extended to the extended state as shown in FIGS. 4 and 5.

As a result, the band length can be made longer in the amount of the length of the extended extension link 7 (the amount of the length of the first extension link 71 and the length of the second extension link 72 that is overlapped with the first extension link 71). With this, the band 1 can be worn even over thick fabrics such as wetsuits.

In addition, when it is desired to return the band 1 to the normal use state, the band 1 is brought into the folded state where the second extension link 72 overlaps the first extension link 71 by performing the procedure reverse of the procedure to make the extended state. Further, this folded state is maintained to be stored inside the clasp cover 3 to be the stored state.

The folded state in which the second extension link 72 overlaps the first extension link 71 is maintained by the second spring bar 77 being latched in the hole 711 of the first extension link 71. With this, the second extension link 72 does not hang down from the first extension link 71 as shown in FIGS. 7 and 8, for example. Therefore, this is preferable in terms of the outer appearance design of the band 1.

As described above, in the band 1 provided with the clasp of the present embodiment, adjustments up to the length of the extension link 7 can be easily made without having to attach or detach the links 11 and readjusting the band length. Moreover, the adjustment in the amount of the length of the extension link 7 can be performed by simply pulling out the extension link 7 from the clasp cover 3 without detaching the clasp portion 10 and making the band 1 in the connection released state.

[Effects]

For example, in the technique disclosed in Japanese Unexamined Patent Application Publication No. 2001-104022, a spring bar is hooked on a sliding window of a length adjustment plate, and the position (length) is finely adjusted using only an elastic member. Therefore, it is not possible to securely fix the band length to just the right length, and the band lacks reliability, especially under harsh environments such as diving.

On the other hand, the clasp 10 allows adjustment of the band length, can withstand repeated use, has excellent wear resistance, and can be firmly fixed.

According to the present embodiment, the clasp 10 has the first extension link 71 formed in a U-shape and whose closed end side is rotatably supported at one end of the clasp cover 3 of the band 1, and the second extension link 72 connected to the open end side of the first extension link 71 via the first spring bar 73 which is a connecting member. The second extension link 72 is fixed to the first extension link 71 at a position different from the connecting position in the first spring bar 73 which is the connecting member. The first extension link 71 is fixed to the clasp cover 3 at a position different from the position where it is rotatably supported at one end of the clasp cover 3.

Further, according to the present embodiment, the connecting member is the first spring rod 73, and the second extension link 72 may be in the folded state arranged so as to overlap with the first extension link 71, and in the extended state pulled out in the length direction of the band 1. The first extension link 71 and the second extension link 72 can be stored inside the clasp cover 3 in the folded state. The first spring bar 73 extends in the penetrating state penetrating through the extension link 71 and the second extension link 72 in the width direction of the band 1. In the stored state in which the first extension link 71 and the second extension link 72 are stored inside the clasp cover 3, both ends of the first spring bar 73 are latched to the clasp cover 3.

Therefore, during the normal usage state, the extension can be stored compactly inside the clasp cover 3, and when wearing a wetsuit, etc., the band length can be easily increased by the length of the first extension link 71 and the second extension link 72.

With this, the band length can be easily adjusted without attaching or detaching the link 11 using a jig or the like, and it is possible to respond flexibly and quickly to different usage situations.

Adjustment of the length of the extension link 7 can be made by simply pulling out the extension link 7 from the clasp cover 3 without releasing the connected state of the band 1. There is no risk of dropping the watch 100 by accident during fine adjustment of the band length.

Also, since the spring bar (the first spring bar 73 and the second spring bar 77) is used as a means for latching the extension link 7, unlike the case where latching is done using a dowel, for example, even when the clasp cover 3 that latches the extension link 7 is made of metal such as SUS, wear and abrasion due to repeated use are less likely to occur, and the latching force (fixing force) does not weaken. Therefore, high reliability can be maintained even after long-term use.

The clasp 10 of the present embodiment also includes a second spring bar 77 that is parallel with the first spring bar 73 and that extends in a penetrating state penetrating through the second extension link 72 in the width direction of the band 1. When in the folded state, the second extension link 72 is fitted inside the first extension link 71, and both ends of the second spring bar 77 are latched to the first extension link 71 when the second extension link 72 is fitted with the first extension link 71 to maintain the fitted state.

As described above, the first extension link 71 and the second extension link 72 can be maintained in a fitted state, so that when the extension link 7 is pulled out from the clasp cover 3, it is possible to prevent the pulled out extension link 7 from hanging down in the direction of gravity. As a result, even when the band 1 is in an extended state, the appearance is not impaired.

In addition, since the spring bar (second spring bar 77) is used to maintain the fitted state of the first extension link 71 and the second extension link 72, wear and abrasion due to repeated use is less likely to occur. Therefore, the latching force (fixing force) can be maintained for a long time.

According to the above embodiment, the first spring bar 73 is fixed by the set screw 78 inserted into the second extension link 72 from a direction perpendicular to the extending direction of the first spring bar 73.

Therefore, the first spring bar 73 does not shift or fall out within the first and second through holes 74, 75 of the second extension link 72, and can be reliably held in a predetermined position.

Further, since the first spring bar 73 can be fixed only with the set screw 78 which does not affect the outer appearance, the first spring bar 73 does not expose anything other than the tip portions 731, and the band 1 has excellent outer appearance design.

According to the above embodiment, the second spring bar 77 is fixed by the set screw 78 inserted into the second extension link 72 from a direction perpendicular to the extending direction of the second spring bar 77.

Therefore, the second spring bar 77 is also reliably fixed while being disposed within the third through hole 76.

Further, since the second spring bar 77 can be fixed only with the set screw 78 which does not affect the outer appearance, the second spring bar 77 does not expose anything other than the tip portions 771, and the band 1 has excellent outer appearance design.

When the clasp 10 having such a configuration is provided on the band 1, the band length can be easily adjusted in the amount of the length of the first extension link 71 and the second extension link 72.

Therefore, when the thickness of the object to be attached changes, such as when wearing the band directly to the arm, or when wearing the band over clothing, it is possible to easily adjust the band length without having to attach and detach the link 11 each time using a jig etc. and it is possible to respond flexibly and quickly to different usage situations. Adjustment of the length of the extension link 7 can be made by simply pulling out the extension link 7 from the clasp cover 3 without releasing the connected state of the band 1. Therefore, it is possible to finely adjust the band length without taking off the band 1. Furthermore, since the adjustment can be made without releasing the connected state of the band 1, there is no risk of accidentally dropping the watch 100 during the adjustment.

Also, since the spring bar is used as a means for latching the extension link 7, unlike the case where latching is done using a dowel, for example, even when the clasp cover 3 that latches the extension link 7 is made of metal such as SUS, wear and abrasion due to repeated use are less likely to occur, and the latching force (fixing force) does not weaken. Therefore, high reliability can be maintained even after long-term use.

The clasp 10 according to the present embodiment also includes the latching unit 5 that maintains the folded state of the fold over member 4 latched to one end side of the clasp cover 3.

The clasp cover 3 according to the present embodiment includes a front plate 31, and a pair of side walls 32 vertically disposed on both sides of the front plate 31. The latching unit 5 includes push buttons 51 that respectively protrude from each of the pair of side walls 32 of the clasp cover 3, and when the push buttons 51 are pushed in from both sides of the clasp cover 3, the folded state of the fold over member 4 is released.

Therefore, unless the latching unit 5 is intentionally released, the folded state of the fold over member 4 will not be released, and the band 1 will not be in the connection released state. This can prevent the band 1 from being accidentally removed.

The clasp 10 of the present embodiment also includes a locking mechanism 6 that restricts the push button 51 of the latching unit 5 from being pushed inward. Among the storage regions inside the clasp cover 3, the latching unit 5 and the locking mechanism 6 are stored toward the latching end side of the fold over member 4, which is one end side. In the storage region on the opposite side from the side where the fold over member 4 is latched, which is the other end side, the first extension link 71 and the second extension link 72 are stored.

Therefore, it is possible to more reliably prevent the band 1 from unintentionally becoming the connection released state. Furthermore, since the extension link 7 can be stored in a vacant part of the storage region inside the clasp cover 3, the extension link 7 can be stored compactly when the band 1 is used without being extended.

[Modification]

Various embodiments of the present invention are described above but the present invention is not limited to the above embodiments, and various modifications are possible without leaving the scope of the present disclosure.

For example, according to the above embodiment, the portion where the first spring bar 73 is latched is the hole 321 formed in the clasp cover 3, and the portion where the second spring bar 77 is latched is the hole 711 formed in the first extension link 71. However, the portion where the first spring bar 73 is latched and the portion where the second spring bar 77 is latched are not limited to this.

Any structure that can latch the tip portions 731, 771 of the spring bar may be used, and for example, it may be a recessed portion that does not penetrate. In this case, the latched part does not appear in the outer appearance, and the outer appearance design is more excellent.

For example, in the above embodiment, the band 1 is composed of a plurality of links 11, and these links 11 are formed of a metal material, but the links 11 are not limited to parts formed of a metal material.

For example, the link 11 may be formed of hard synthetic resin such as ABS resin, super engineering plastic such as polyarylate (PAR), engineering plastic such as polyacetal (POM), or polycarbonate (PC), or ceramics.

Furthermore, all of the links do not have to be made of the same material, and the band can be made by combining links formed of metal materials, links formed of various resins, links formed of ceramics, etc. By forming the links from various materials in this way, variations in texture and design are possible.

The material forming the clasp 10 is not limited to those shown in the embodiments, and various materials such as those described above may be used, for example.

Further, the band may include a first band and a second band, and may have a structure in which these bands are connected by a clasp, and is not limited to one composed of a plurality of links.

For example, a first band and a second band, which are each made of various kinds of leather, resin, etc., in one piece may be connected by a clasp.

Further, the clasp is not limited to the three-fold type clasp shown in the above embodiment.

Any other type of clasp may be used as long as the first extension link and the second extension link can be stored inside the clasp cover (on the non-visible side).

Furthermore, the detailed configurations of the latching unit 5 and the locking mechanism 6 are not particularly limited. It is not essential to provide a latching unit or a locking mechanism, and a clasp without these may be used.

Furthermore, the configuration of the extension link 7 is not limited to that shown in the embodiment.

For example, the first extension link that is latched to the clasp cover 3 may have a block shape, and the second extension link connected thereto may be formed in a U-shape into which the first extension link can be fitted.

In this case, a first spring bar and a second spring bar are provided inside the first extension link, and the first extension link is latched in the second extension link by the second spring bar.

In addition, in the above embodiment, an example has been shown in which the set screw 78 is inserted from the surface corresponding to the inner surface of the clasp cover 3 (the back surface of the front plate 31) in the stored state. However, the insertion direction of the set screw 78 needs only to be able to press the first spring bar 73 and the second spring bar 77 perpendicularly to the first spring bar 73 and the second spring bar 77. Since the set screw 78 has a shape without a screw head and does not protrude outward, it may be inserted from the side of the second extension link 72, for example, if there is no problem in assembling it.

Figure 10:
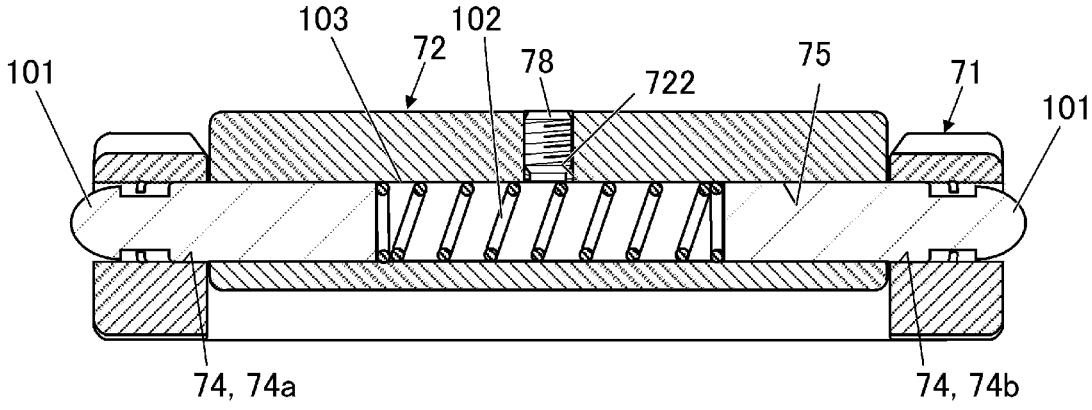
FIG. 10 is a cross-sectional view of the extension link in a modified example.

In the above embodiment, the first spring bar 73 extends in a penetrating state to penetrate through the first extension link 71 and the second extension link 72 in the width direction of the band 1. Although the structure is such that both ends are latched to the clasp cover 3 when the first extension link 71 and the second extension link 72 are stored inside the clasp cover 3, the present invention is not limited to this configuration. For example, FIG. 10 shows a cross-sectional view of the extension link in a modified example.

The connecting member is configured such that a pair of sliding parts 101 are pushed outward from both ends of a pipe 103 by the spring force of a spring member 102. In this case, the pipe 103 is formed so that its outer diameter is the same as or slightly smaller than the inner diameter of the first through hole 74 (74*a*, 74*b*).

The spring member 102 is, for example, a coil spring, and its outer diameter is formed to be slightly smaller than the inner diameter of the pipe 103.

The spring member 102 is configured such that both ends thereof come into elastic contact with the respective inner ends of a pair of sliders 101 and urge the pair of sliders 101 in a direction to push out the pair of sliders 101 from the inside of the pipe 103 to the outside.

Furthermore, the band 1 to which the clasp 10 of the present invention is applied is not limited to a band attached to a diver's watch.

For example, it can be widely applied to bands attached to devices (for example, various sports watches, various biological information measuring devices) that are assumed to be worn over ski clothes, thick outdoor jackets, etc.

Further, in each of the above embodiments, the case where the clasp 10 is provided on the band 1 of a watch or the like worn on the wrist is exemplified, but the band to which the clasp of the present invention can be applied is not limited to a watchband.

The clasp of the present invention can be widely applied to bands other than bands worn on the arm, as long as the band has a structure in which a first band and a second band are connected by a clasp.

Various embodiments of the present invention have been described but specific configurations, structures and positions shown in the above embodiments may be suitably changed without leaving the scope of the invention. The scope of the present invention includes the scope of the claims and their equivalents.

The invention claimed is:

1. A clasp comprising:

a first extension link that is formed in a U-shape and in which a closed end side is rotatably supported at one end of a clasp cover of a band; and a second extension link connected to an open end side of the first extension link via a connecting member, wherein, the second extension link is fixed to the first extension link at a position different from a connected position in the connecting member, and the first extension link is fixed to the clasp cover at a position different from the one end of the clasp cover where the first extension link is rotatably supported.

2. The clasp according to claim 1, wherein, the connecting member is a first spring bar, and the second extension link is configured to be capable of taking a folded state in which it is arranged to overlap with the first extension link, and an extended state in which it is pulled out in a length direction of the band.

3. The clasp according to claim 2, wherein the first extension link and the second extension link are configured to be capable of being stored inside the clasp cover in the folded state.

4. The clasp according to claim 3, wherein, the first spring bar extends in a penetrating state to penetrate through the first extension link and the second extension link in a width direction of the band, and both ends of the first spring bar are latched to the clasp cover in a stored state in which the first extension link and the second extension link are stored inside the clasp cover.

5. The clasp according to claim 4, further comprising a second spring bar that is parallel to the first spring bar, and that extends in a penetrating state penetrating through the second extension link in the width direction of the band.

6. The clasp according to claim 5, wherein the second extension link is in a fitted state fitted inside the first extension link when in the folded state.

7. The clasp according to claim 6, wherein both ends of the second spring bar are latched to the first extension link when the second extension link is fitted in the first extension link and the fitted state is maintained.

8. The clasp according to claim 7, wherein the second spring bar is fixed by a set screw inserted into the second extension link from a direction perpendicular to an extending direction of the second spring bar.

9. The clasp according to claim 7, wherein a hole in which each end of the second spring bar is latched to the first extension link when the second extension link is fitted with the first extension link is formed on an inner side surface of the first extension link.

10. The clasp according to claim 4, wherein the first spring bar is fixed by a set screw inserted into the second extension link from a direction perpendicular to an extending direction of the first spring bar.

11. The clasp according to claim 4, wherein the clasp cover includes a front plate and a pair of side walls vertically disposed on both sides of the front plate.

12. The clasp according to claim 11, wherein a hole in which each end of the first spring bar is latched when in a stored state in which the first extension link and the second extension link are stored inside the clasp cover is formed in each of the pair of side walls of the clasp cover.

13. The clasp according to claim 4, further comprising a latching unit that maintains a folded state of a fold over member latched to the one end side of the clasp cover.

14. The clasp according to claim 13, wherein the clasp cover includes a front plate and a pair of side walls vertically disposed on both sides of the front plate.

15. The clasp according to claim 14, wherein the latching unit includes push buttons that respectively protrude from each of the pair of side walls of the clasp cover, and when the push buttons are pushed in from both sides of the clasp cover, the folded state of the fold over member is released.

16. The clasp according to claim 15, wherein the clasp includes a locking mechanism that restricts the push button of the latching unit from being pushed in.

17. The clasp according to claim 16, wherein among the storage regions inside the clasp cover, the latching unit and the locking mechanism are stored toward the latching end side of the fold over member which is one end side and in the storage region on the opposite side from the side where the fold over member is latched, which is the other end side, the first extension link and the second extension link are stored.

18. A band comprising:

a clasp including, a first extension link that is formed in a U-shape and in which a closed end side is rotatably supported at one end of a clasp cover of a band, and a second extension link connected to an open end side of the first extension link via a connecting member, wherein, the second extension link is fixed to the first extension link at a position different from a connected position in the connecting member, and the first extension link is fixed to the clasp cover at a position different from the one end of the clasp cover where the first extension link is rotatably supported.

19. A band comprising:

a clasp including, a first extension link that is formed in a U-shape and in which a closed end side is rotatably supported at one end of a clasp cover of the band, and a second extension link connected to an open end side of the first extension link via a connecting member, wherein, the second extension link is fixed to the first extension link at a position different from a connected position in the connecting member, the first extension link is fixed to the clasp cover at a position different from the one end of the clasp cover where the first extension link is rotatably supported, the connecting member is a first spring bar, the second extension link is configured to be capable of taking a folded state in which it is arranged to overlap with the first extension link, and an extended state in which it is pulled out in a length direction of the band, the first extension link and the second extension link are configured to be capable of being stored inside the clasp cover in the folded state, and the first spring bar extends in a penetrating state to penetrate through the first extension link and the second extension link in a width direction of the band, and wherein both ends of the first spring bar are latched to the clasp cover in a stored state in which the first extension link and the second extension link are stored inside the clasp cover.

* * * * *